US006550587B1

(12) United States Patent
Yuasa et al.

(10) Patent No.: US 6,550,587 B1
(45) Date of Patent: Apr. 22, 2003

(54) OPERATING BOARD FOR ELEVATOR

(75) Inventors: Eiji Yuasa, Tokyo (JP); Yasuyuki Tamaki, Tokyo (JP); Mitsuhiko Yamamoto, Tokyo (JP); Masayuki Miyawaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/009,752

(22) PCT Filed: Jun. 16, 2000

(86) PCT No.: PCT/JP00/03966

§ 371 (c)(1),
(2), (4) Date: Dec. 12, 2001

(87) PCT Pub. No.: WO01/98189

PCT Pub. Date: Dec. 27, 2001

(51) Int. Cl.[7] ..... B66B 3/02
(52) U.S. Cl. ..... 187/394; 187/396
(58) Field of Search ..... 187/391, 393, 187/394, 395, 396

(56) References Cited

U.S. PATENT DOCUMENTS

| | | | | | |
|---|---|---|---|---|---|
| D283,687 | S | * | 5/1986 | Walser | D10/108 |
| 4,972,926 | A | * | 11/1990 | Tsuji et al. | 187/380 |
| 5,454,448 | A | * | 10/1995 | Bittar et al. | 187/384 |
| 5,679,934 | A | * | 10/1997 | Juntunen et al. | 187/384 |
| 5,789,715 | A | * | 8/1998 | Kakko et al. | 187/393 |
| 5,821,479 | A | * | 10/1998 | Kondo et al. | 187/395 |
| 5,969,306 | A | | 10/1999 | Velauthapillai et al. | |
| 6,105,729 | A | * | 8/2000 | Nakamori et al. | 187/391 |
| 6,161,654 | A | * | 12/2000 | Sirigu et al. | 187/391 |
| 2001/0035314 | A1 | * | 11/2001 | Yoshida et al. | 187/382 |

FOREIGN PATENT DOCUMENTS

| | | | | | |
|---|---|---|---|---|---|
| FR | 002793933 | A1 | * | 11/2000 | B66B/3/02 |
| GB | 002241090 | A | * | 8/1991 | B66B/1/20 |
| JP | 63-235278 | | | 9/1988 | |
| JP | 63-310483 | | | 12/1988 | |
| JP | 7-10404 | | | 1/1995 | |
| JP | 7-157216 | | | 6/1995 | |
| JP | 407242400 | A | * | 9/1995 | B66F/9/24 |
| JP | 8-143239 | | | 6/1996 | |
| JP | 9-272666 | | | 10/1996 | |
| JP | 11-092045 | | | 4/1999 | |
| JP | 2000-007240 | A2 | | 1/2000 | |

* cited by examiner

*Primary Examiner*—Jonathan Salata
(74) *Attorney, Agent, or Firm*—Leydig, Voit & Mayer, Ltd.

(57) ABSTRACT

In an operating panel for an elevator, designation floor registering buttons and floor information display portions are disposed in a touch panel adjacent to one another, and an indicator bar for indicating a position of car is disposed between the destination floor registering buttons and the floor information display portions. When the destination floor registering buttons are operated in the car, their display configurations are changed. Further, when hall button devices are operated, the display configurations, i.e., colors and/or display areas, of the corresponding floor information display portions are changed.

11 Claims, 5 Drawing Sheets

OPERATING BOARD FOR ELEVATOR

TECHNICAL FIELD

The present invention relates to an operating panel for an elevator, which is installed in a car or at an elevator hall and has buttons for registering destination floors.

BACKGROUND ART

Conventionally, Japanese Patent No. 2502077 discloses an elevator where guiding patterns corresponding to operating situations are selectively displayed on a display device disposed at a car or an elevator hall.

Further, Japanese Patent No. 2502610 discloses an elevator where general information such as a date and time, weather forecast or the like is normally displayed on a display device disposed at an elevator hall, and when a hall call is registered, operation information such as a car position or the like is displayed on the display device.

Furthermore, Japanese Patent Application Laid-Open No. Hei 6-271232 discloses an elevator where train operation information is displayed in a display device disposed in a car as it descends.

Further, Japanese Patent Application Laid-Open No. Hei 8-59115 discloses an elevator where information concerning weather is displayed on a display in a car when a call for an entrance floor is registered in the car.

Furthermore, Japanese Patent Application Laid-Open No. Hei 8-34572 discloses an elevator where teletext, telecast or the like is normally displayed by an image display device in a car, and an evacuation route corresponding to the floor where the car is located is displayed by the image display device in case of emergencies such as earthquakes.

Further, Japanese Patent Application Laid-Open No. Hei 11-92045 discloses an elevator where general information such as weather forecasts, and car waiting time or the like are displayed on a display device disposed at an elevator hall.

However, in the conventional display methods, the position and state of the car, and the wait time etc., can not be sufficiently understood clearly, therefore a display which can be more easily understood is required.

DISCLOSURE OF THE INVENTION

The present invention is made to solve the problem mentioned above, and an object of the present invention is to provide an operating panel for an elevator, wherein information concerning the position and state of a car, the floors where the car stops, etc., can be more clearly understood at a glance.

To this end, according to one aspect of the present invention, there is provided an operating panel for an elevator comprising an operating panel body, and a touch panel portion provided at a front surface of the operating panel body, wherein the touch panel portion includes: a plurality of destination floor registering buttons arranged in a line vertically and changing their display configurations by being operated; and a band-like indicator bar disposed beside the line of the destination floor registering buttons for indicating a position of a car.

BEST MODE FOR CARRYING OUT THE INVENTION

Preferred embodiments of the present invention will be described below with reference to the accompanying drawings.

First Embodiment

Figure 1:
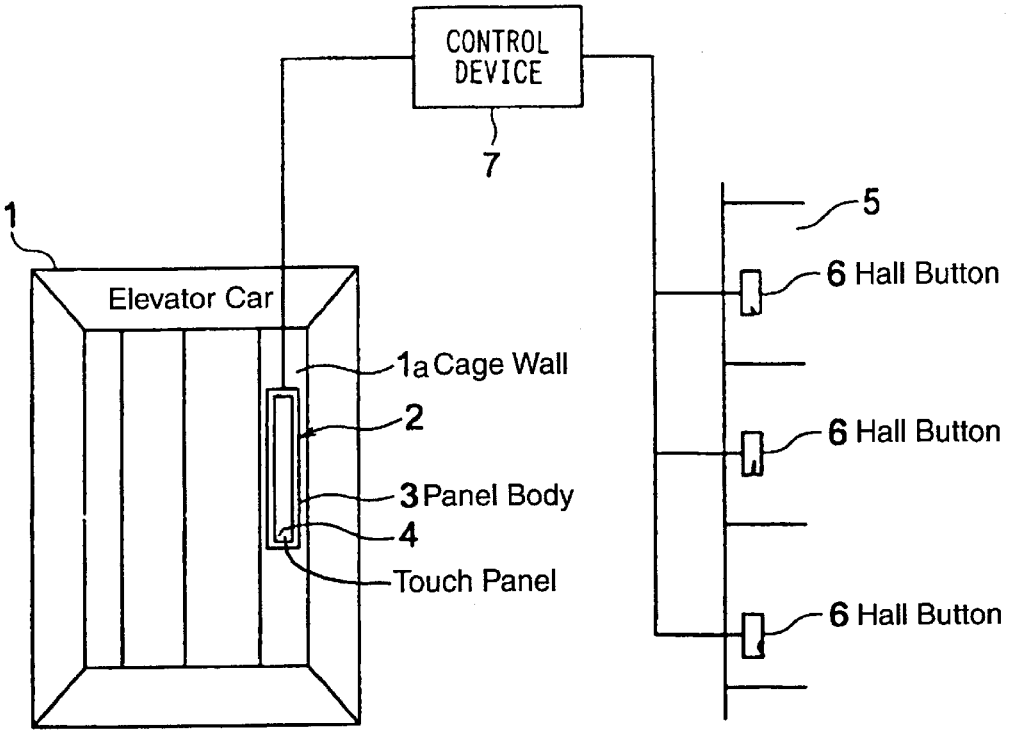
FIG. 1 is a structural view showing an operating panel for an elevator according to a first embodiment of the present invention.

FIG. 1 is a structural view showing an operating panel for an elevator according to a first embodiment of the present invention. In the figure, an operating panel 2 is installed in a car 1. The operating panel 2 has an operating panel body 3 embedded in a cage wall 1*a,* and a touch panel portion 4 provided at a front surface of the operating panel body 3. A hall button device 6 is provided at an elevator hall 5 of each floor. The operating panel 2 and the hall button device 6 are connected to a control device 7.

Figure 2:
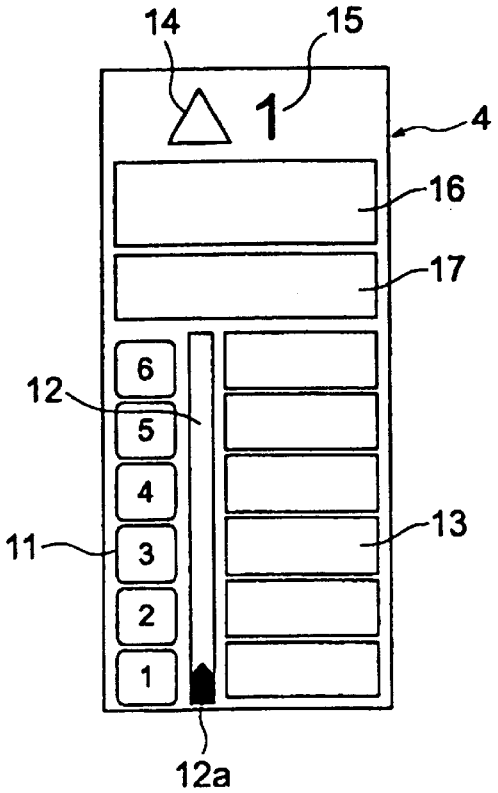
FIG. 2 is a front view showing the touch panel portion in FIG. 1.

FIG. 2 is a front view showing the touch panel portion in FIG. 1, more particularly showing a state where a call is registered neither at the car 1 nor at the elevator halls 5. The touch panel portion 4 is provided with a plurality of destination floor registering buttons (button display portions) 11. The destination floor registering buttons 11 are arranged in a line vertically. Although, floor numbers are normally displayed in rectangular button displays in the destination floor registering buttons 11, display configurations of the destination floor registering buttons 11 change by being operated.

A band-like indicator bar 12 for indicating the position of the car 1 is disposed beside an area of the line of the destination floor registering buttons 11. In the indicator bar 12, the car indicating mark 12*a* which is an arrow like mark showing the moving direction of the car 1 is moved to correspond to the position of the car 1. The whole of the indicator bar 12 corresponds to the hoistway, and the car indicating mark 12*a* corresponds to the car 1 which is raised and lowered in the hoistway.

A plurality of floor information display portions 13 for displaying information about the landing floors are disposed beside areas of the destination floor registering buttons 11 of the corresponding landing floors with the indicator bar 12 interposed, respectively. Although, landing floor information, for example, sales floor information in a department store, are normally displayed in rectangular frames in the floor information display portions 13, the display configurations of the floor information display portions 13 are changed by operation of the hall button device 6 at each elevator hall 5.

A direction display portion 14 showing the moving direction of the car 1, a car position display portion 15 showing the present position of the car 1, an image display portion 16 and a message display portion 17 are disposed in an area above the destination floor registering buttons 11, the indicator bar 12 and the floor information display portions 13.

Figure 3:
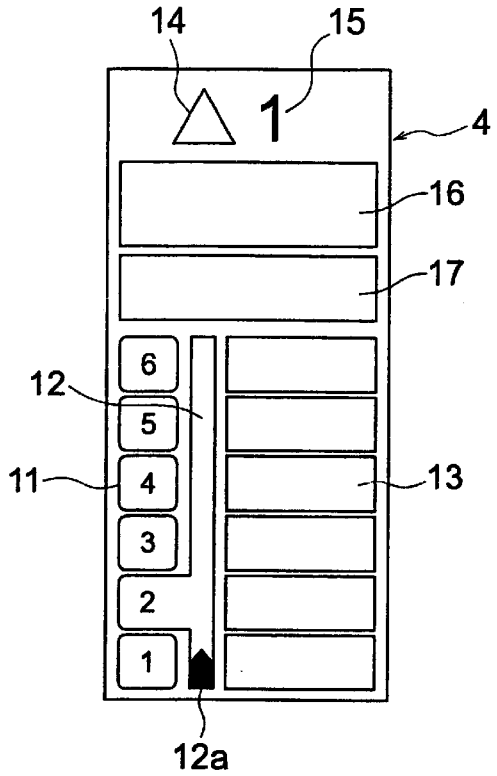
FIG. 3 is a front view showing a state where the destination floor registering button in FIG. 2 has been operated.

FIG. 3 is a front view showing a state where the destination floor registering button 11 in FIG. 2 has been operated, to be more specific the destination floor registering button 11 of the second floor has been operated in FIG. 3. The color of the destination floor registering buttons 11 is changed into the same color as the indicator bar 12 by being operated. Further, when the destination floor registering buttons 11 are operated, the areas of the destination floor registering buttons 11 are expanded to the indicator bar 12 side to be connected with the indicator bar 12.

When the destination floor registering button 11 is operated, a signal is output to the control device 7 to register the call, and the display configuration of the destination floor registering button 11 which is operated changes.

Figure 4:
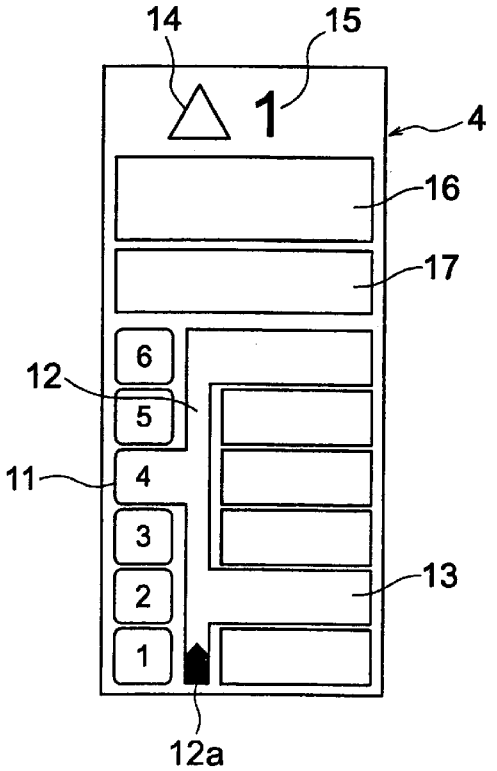
FIG. 4 is a front view showing a state where the display configurations of the floor information display portions in FIG. 2 have changed.

FIG. 4 is a front view showing a state where the display configurations of the floor information display portions 13 in FIG. 2 have changed, to be more specific the display configurations of the floor information display portions 13 of the second and fourth floors have changed in FIG. 4. The color of the floor information display portions 13 is changed into the same color as the indicator bar 12 when the hall button devices 6 of the corresponding elevator halls 5 are operated. Further, when the hall button devices 6 are operated, the areas of the corresponding floor information display portions 13 are expanded to the indicator bar 12 side to be connected with the indicator bar 12.

When the hall button device 6 is operated, the call is registered in the control device 7, and a signal is output from the control device 7 to the operating panel 2. When the signal from the control device 7 is received, the display configuration of the corresponding floor information display portion 13 changes.

In such an operating panel for an elevator, since the destination floor registering buttons 11 and the indicator bar 12 are disposed in the touch panel portion 4 to be adjacent to one another, and the display configurations of the destination floor registering buttons 11 change when they are operated, the position and the state of the car, predetermined stop floors and the like can be understood through intuition, and a car waiting time or the like can also be intuitively understood. Further, the passengers can clearly understand that a call has been registered.

Further, since the floor information display portions 13 are disposed be side the destination floor registering buttons 11, and the display configurations of the corresponding floor information display portions 13 change when the hall button devices 6 are operated, the state of the call registrations at the elevator halls 5 can be understood at a glance. Accordingly, passengers in the car 1 can be kept from falsely getting off the car 1 when the car 1 stops before the destination floor in response to a call from the elevator hall 5. Also, the passengers in the car 1 can open space so that the passengers from the elevator hall 5 can easily get on the car 1.

It should be noted that, while, in the first embodiment, the operating panel 2 is installed in the car 1, it is also possible for the same operating panel 2 to be installed at the elevator hall 5 as the hall button device 6. Because of this, the passengers waiting at the elevator hall 5 can be more clearly informed of the operating conditions. Further, it can be previously understood before the car arrives whether a passenger is getting off the car 1 or not, thereby keeping the passengers from colliding and contacting each other at the time of getting on and off the car 1.

Second Embodiment

Further, while, in the first embodiment, the corresponding destination floor registering buttons 11 and the corresponding floor information display portions 13 are integrated with the indicator bar 12 when the call is registered, the methods of changing the display configurations of the destination floor registering buttons 11 and the floor information display portions 13 is not limited to integration.

Figure 5:
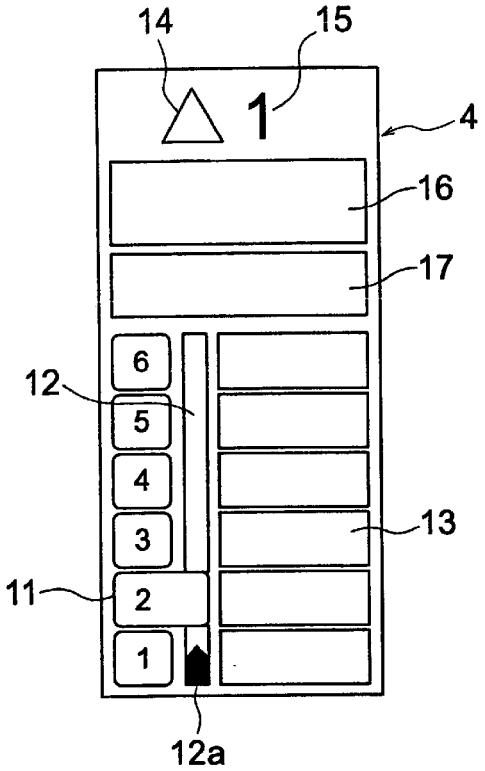
FIG. 5 is a front view showing a state where a destination floor registering button of a touch panel portion according to a second embodiment of the present invention has been operated.

For example, FIG. 5 is a front view showing a state where a destination floor registering button of a touch panel portion according to a second embodiment of the present invention has been operated, to be more specific the destination floor registering button 11 for the second floor has been operated in FIG. 5. When the destination floor registering buttons 11 are operated, their areas are expanded to the indicator bar 12 side so as to divide the indicator bar 12 into an upper part and a lower part with a different color from the indicator bar 12.

Figure 6:
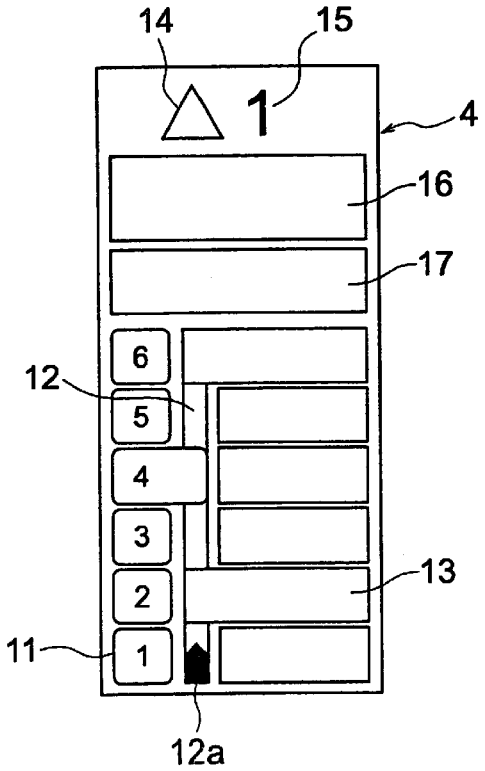
FIG. 6 is a front view showing a state where the display configurations of the hall information display portions of the touch panel portion in FIG. 5 have changed.

Furthermore, FIG. 6 is a front view showing a state where the display configurations of the hall information display portions 13 of the touch panel portion 4 in FIG. 5 have changed, to be more specific the display configurations of the hall information display portions 13 of the second and sixth floors have changed in FIG. 6. The areas of the floor information display portions 13 are expanded to the indicator bar 12 side so as to divide the indicator bar 12 into an upper part and a lower part with a different color from the indicator bar 12 when the hall button devices 6 of the corresponding elevator halls 5 are operated.

Figure 7:
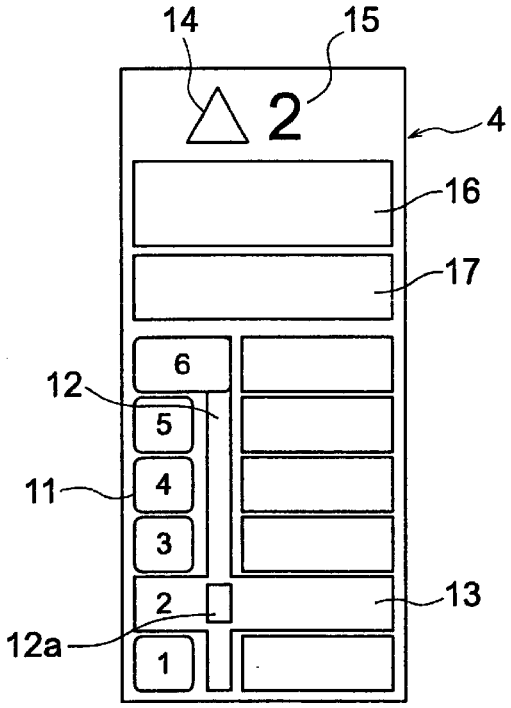
FIG. 7 is a front view showing a state of the touch panel portion in FIG. 5 when a car arrives.

FIG. 7 is a front view showing a state of the touch panel portion 4 in FIG. 5 when the car arrives, more particularly showing a state when the car 1 reaches the second floor. When the car 1 reaches the destination floor, that information is sent to the operating panel, and the destination floor registering button 11 and the floor information display portion 13 of the corresponding floor are integrated with the indicator bar 12 by the same color. Also, the car indicating mark 12*a* turns into a square shape to show the stopping of the car 1.

In such a method of changing the display configurations of the destination floor registering buttons 11 and the floor information display portions 13 described above, the information concerning the position and the state of a car, predetermined stop floors and the like can be plainly and clearly presented to the passengers, just as in the first embodiment.

Third Embodiment

Figure 8:
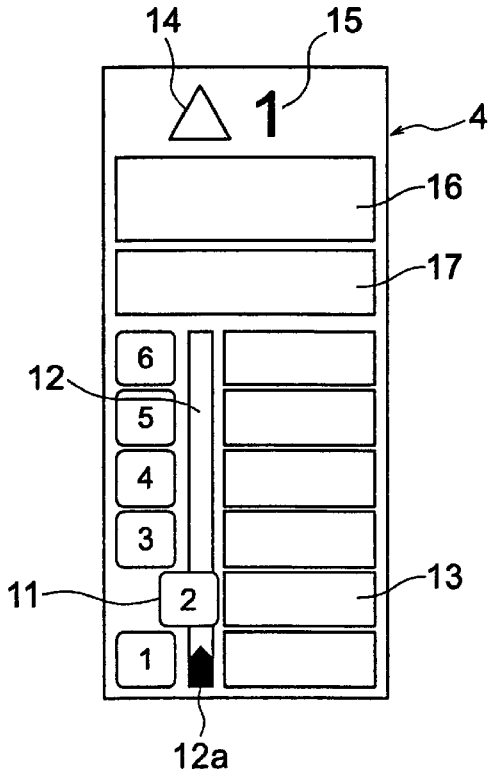
FIG. 8 is a front view showing a state where a destination floor registering button of a touch panel portion according to a third embodiment of the present invention has been operated.
Figure 9:
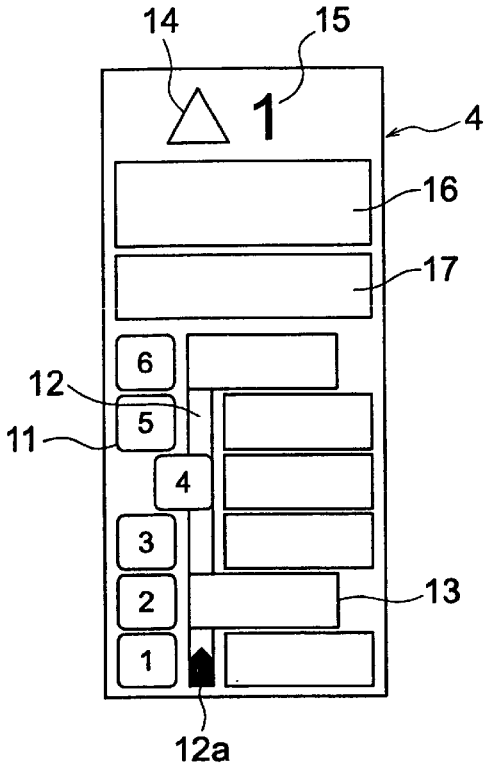
FIG. 9 is a front view showing a state where the display configurations of the hall information display portions of the touch panel portion in FIG. 8 have changed.

Further, FIG. 8 is a front view showing a state where a destination floor registering button of a touch panel portion 4 according to a third embodiment of the present invention has been operated, and FIG. 9 is a front view showing a state where the display configurations of the hall information display portions 13 of the touch panel portion 4 in FIG. 8 have changed.

When the destination floor registering buttons 11 are operated, their areas are moved to the indicator bar 12 side so as to divide the indicator bar 12 into an upper part and a lower part with a different color from the indicator bar 12.

Further, the areas of the floor information display portions 13 are moved to the indicator bar 12 side so as to divide the indicator bar 12 into an upper part and a lower part with a different color from the indicator bar 12 when the hall button devices 6 of the corresponding elevator halls 5 are operated.

In such a method of changing the display configurations, the information concerning the position and state of the car, predetermined stop floors and the like can be plainly and clearly presented to the passengers as the same as in the first embodiment.

Fourth Embodiment

Figure 10:
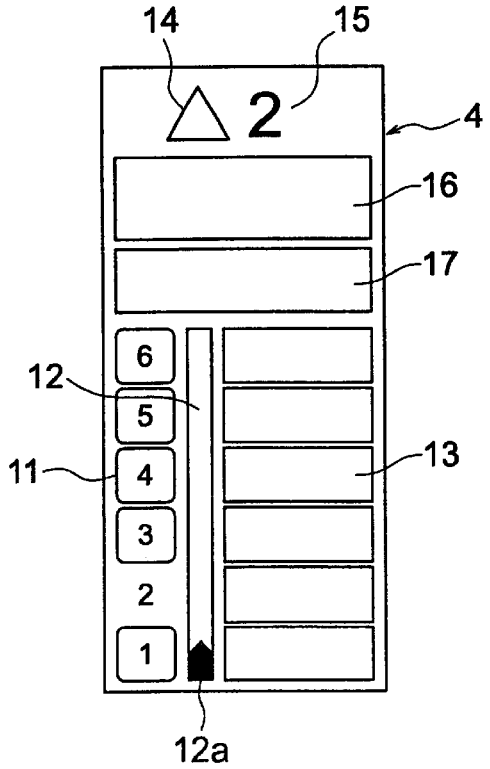
FIG. 10 is a front view showing the display state of a touch panel portion according to a fourth embodiment of the present invention.

Next, FIG. 10 is a front view showing a display state of a touch panel portion 4 according to a fourth embodiment of the present invention. In the figure, for floors (the second floor in this embodiment) that cannot be registered as the destination floor, only the floor number is displayed at the corresponding portion of the column of destination floor registering buttons 11, but the destination floor registering button 11 for the floor that cannot be registered is in a non-display state.

In such a display configuration since the floors that cannot be registered can be understood at a glance, the mistake of trying to register that floor can be prevented.

What is claimed is:

1. An operating panel for an elevator comprising:

an operating panel body, and a touch panel portion located at a front surface of said operating panel body and including a plurality of destination floor registering buttons arranged in a line, vertically, in a first display configuration, and an indicator bar disposed beside said destination floor registering buttons for indicating position of an elevator car and having a display configuration, wherein, upon operation of any of said destination floor registering buttons, the first display configuration of said destination floors button changes to a second display configuration that changes the display configuration of said indicator bar.

2. The operating panel for an elevator according to claim 1, wherein a car indicating mark showing moving direction of the elevator car moves in said indicator bar to correspond to the position of the elevator car.

3. The operating panel for ran elevator according to claim 1, wherein, upon operation of any of said destination floor registering buttons, said destination floor registering button expands and connects with said indicator bar and takes a color the same as said indicator bar.

4. The operating panel for an elevator according to claim 1, wherein, upon operation of any of said destination floor registering buttons, said destination floor registering button expands and divides said indicator bar into an upper part and a lower part with a different color from said indicator bar.

5. The operating panel for an elevator according to claim 1, wherein, upon operation of any of said destination floor registering buttons, said destination floor registering button moves and divides said indicator bar into an upper part and a lower part with a different color from said indicator bar.

6. The operating panel for an elevator according to claim 1, wherein said touch panel portion further includes a plurality of floor information display portions disposed beside said destination floor registering buttons of corresponding landing floors, respectively, with said indicator bar interposed for displaying landing floor information, display configurations of said floor information display portions being changed by operation of hall button devices of corresponding elevator halls.

7. The operating panel for an elevator according to claim 6, wherein areas of said floor information display portions expand and connect with said indicator bar and take a color the same as said indicator bar when the hall button devices of the corresponding elevator halls are operated.

8. The operating panel for an elevator according to claim 6, wherein areas of said floor information display portions expand and divide said indicator bar into an upper part and a lower part with a different color from said indicator bar when the hall button devices of the corresponding elevator halls are operated.

9. The operating panel for an elevator according to claim 6, wherein areas of said floor information display portions move and divide said indicator bar into an upper part and a lower part with a different color from said indicator bar when the hall button devices of the corresponding elevator halls are operated.

10. The operating panel for an elevator according to claim 6, wherein a destination floor registering button and a floor information display portion for the destination floor are connected by said indicator bar and take the same color when the elevator car stops at the destination floor corresponding to the floor information display portion.

11. An operating panel for an elevator comprising:

an operating panel body; and a touch panel portion located at a front surface of a said operating panel body and including a plurality of destination for registering buttons arranged in a line, vertically changing their configurations upon being operated, and an indicator bar disposed beside said destination for registering buttons for indicating position of an elevator car, wherein only a floor number and not a button is displayed at a corresponding part in said destination floor registering buttons for floors that cannot be registered as destination floors.

* * * * *